United States Patent [19]

Adamoli et al.

[11] 4,430,936

[45] Feb. 14, 1984

[54] STRIKER MECHANISM FOR A HIGH SPEED SERIAL PRINTER

[75] Inventors: Contardo Adamoli, Castellamonte; Francesco Tonengo, Chivasso, both of Italy

[73] Assignee: Ing. C. Olivetti & C., S.p.A., Ivrea, Italy

[21] Appl. No.: 268,104

[22] Filed: May 28, 1981

[30] Foreign Application Priority Data

Jun. 5, 1980 [IT] Italy ..... 67870 A/80

[51] Int. Cl.[3] ..... B41J 9/42

[52] U.S. Cl. ..... 101/93.48; 101/93.02; 400/157.2; 400/167; 400/686

[58] Field of Search ..... 400/454, 455, 157.2, 400/167, 686, 435; 101/93.48, 93.02, 93.32, 93.30, 93.31, 93.33, 93.34, 93.29; 184/102, 16, 19, 22, 25; 335/271, 277

[56] References Cited

U.S. PATENT DOCUMENTS

| | | | |
|---|---|---|---|
| 884,347 | 4/1908 | Yetman | 400/496 X |
| 1,510,563 | 10/1924 | Seib | 400/454 X |
| 1,798,450 | 3/1931 | Brugger | 184/102 |
| 3,152,540 | 10/1964 | Pensavecchia et al. | 400/157.2 X |
| 3,280,956 | 10/1966 | Koenen | 400/454 X |
| 3,426,675 | 2/1969 | Dalton | 101/93.33 |
| 3,889,793 | 6/1975 | Cattaneo | 400/124 |
| 3,994,218 | 11/1976 | Riley | 335/271 |
| 4,023,663 | 5/1977 | Engler | 184/102 X |
| 4,062,285 | 12/1977 | Deetz et al. | 101/93.02 |
| 4,084,680 | 4/1978 | Deetz | 400/144.2 |
| 4,308,794 | 1/1982 | Adamoli et al. | 400/157.2 X |

FOREIGN PATENT DOCUMENTS

| | | | |
|---|---|---|---|
| 6609830 | 10/1972 | Fed. Rep. of Germany . | |
| 2629127 | 1/1978 | Fed. Rep. of Germany . | |
| 513656 | 2/1921 | France | 184/102 |

OTHER PUBLICATIONS

IBM Technical Disclosure Bulletin, "Impact Printer Hammer Damping System", vol. 22, No. 8B, Jan. 1980, p. 3498, Hall et al.

*Primary Examiner*—Edgar S. Burr
*Assistant Examiner*—Charles A. Pearson
*Attorney, Agent, or Firm*—Schuyler, Banner, Birch, McKie & Beckett

[57] ABSTRACT

A striker mechanism for a high speed serial printer, for example of the daisy wheel type, includes a hammer movable axially towards the platen under the action of an electro-magnet whose armature carries a striker, and against the action of a return spring. Two lubricating felt pads are arranged on opposite sides with respect to the striker hammer and are pressed against the hammer by the grip of a spring for damping the hammer vibrations during the printing cycle. The armature comprises a pivoted lever which is damped with respect to its pivot by means of a felt washer and the lever is damped on return by a helical spring on a rod with a reduced diameter center section where it is struck by a pad on the lever.

10 Claims, 5 Drawing Figures

STRIKER MECHANISM FOR A HIGH SPEED SERIAL PRINTER

BACKGROUND OF THE INVENTION

The present invention relates to a striker mechanism for a high speed serial printer, including a hammer movable with respect to a fixed guide in the direction of the platen of the printer. The striker mechanism is particularly useful in a printer of the daisy wheel type, which can be mounted on a typewriter, an automatic text printer, an accounting machine, a teleprinter or any similar printing machine.

In this type of high speed printer, in which the frequency of the printing cycle is very high, one of the technical problems to be resolved is that of eliminating the vibrations of the printing hammer and of reducing to the minimum the settling time of the whole striker mechanism after the printing of a selected character, in such a way as to perform a new printing cycle immediately after the preceding cycle.

In a known striker mechanism, for damping the oscillations of a printing hammer, the hammer is connected to a pawl engageable with a ratchet wheel rotatable between two friction discs. In this way, when the hammer turns towards its rest position, the pawl makes the ratchet wheel rotate against the action of the friction discs, which act as dampers for the hammer. The pawl does not act on the ratchet wheel during the striking action of the hammer but only during its movement towards the rest position. This mechanism therefore only partly solves the technical problem discussed above since it does not eliminate the oscillations about the stopping position, still less the intrinsic vibrations of the hammer.

SUMMARY OF THE INVENTION

The above mentioned technical problem is fully solved, however, and the disadvantages of the known device eliminated by the striker mechanism according to the invention which comprises at least one damper element fixedly mounted with respect to the hammer guide and positioned along the direction of movement of this hammer, and by means which hold the damper element in contact with the hammer with a predetermined pressure.

According to a development of the invention, the damper element includes a pad of felt impregnated with lubricating oil and is provided with a spring for constantly urging this pad against the hammer with a predetermined pressure.

BRIEF DESCRIPTION OF THE DRAWING

The invention will now be described in greater detail, by way of example, with reference to the drawing, in which:

FIG. 2 is a partially sectioned front view of the mechanism of FIG. 1;

DESCRIPTION OF A PREFERRED EMBODIMENT

Figure 1:
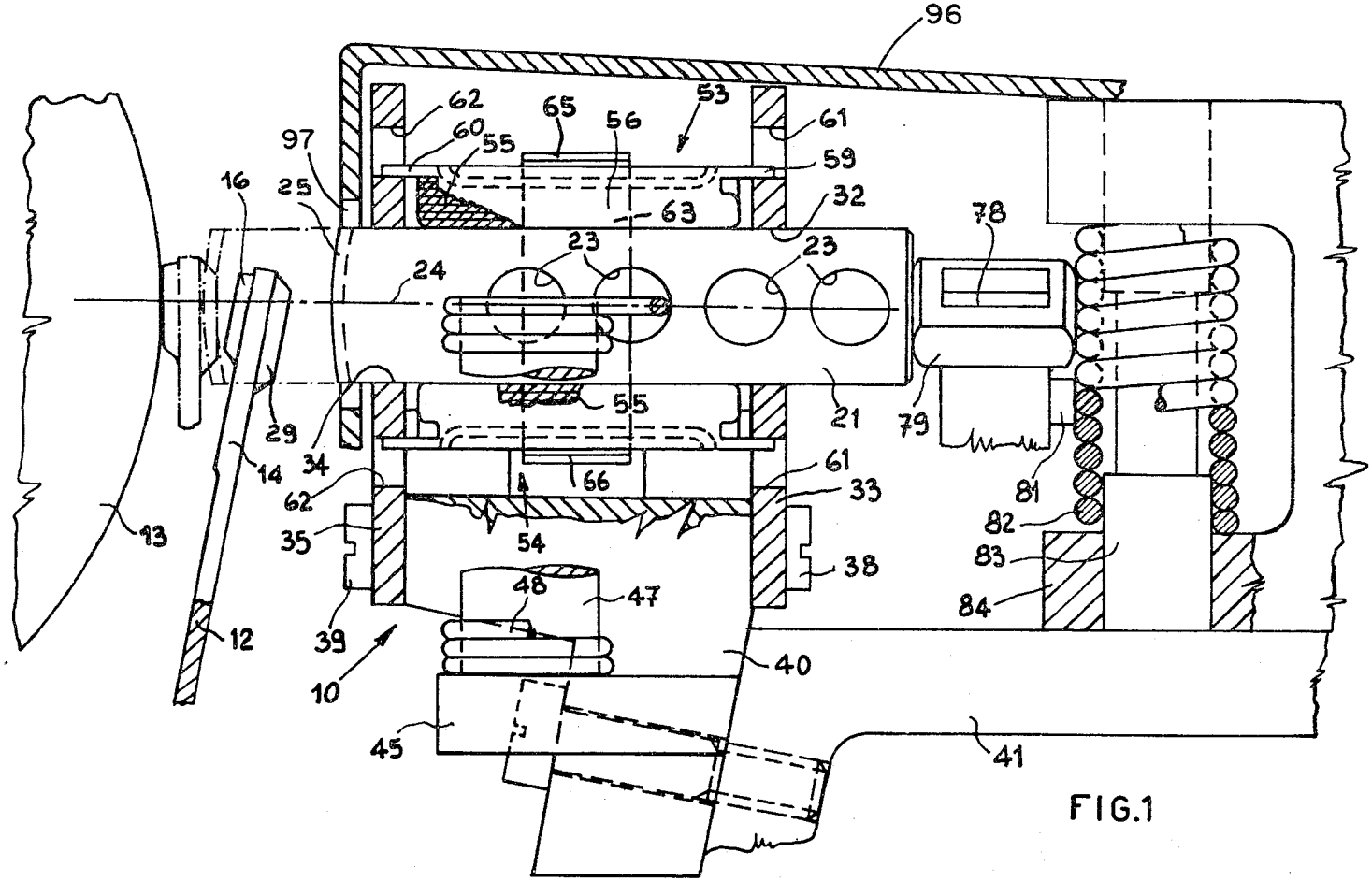
FIG. 1 is a partially sectioned left side view of the striker mechanism embodying the invention.

With reference to FIG. 1, a striker mechanism 10 is shown applied to a high speed serial printer comprising a character-carrying disc 12 having flexible blades 14, located in front of a platen 13. The character-carrying disc 12 is of known type, for example of the type described in the U.S. Pat. No. 4,036,348 assigned to the same assignee of the present patent application and includes a rotatable hub 15 (FIG. 4) on which the flexible blades 14 are radially mounted. On the periphery of each blade 14 there is arranged a character 16 which, by the rotation of the hub 15, is carried around to the printing position in front of the platen 13.

The striker mechanism 10 includes a hammer 21 made, for example, of sintered metal and having a substantially rectangular section. In order to lighten the hammer 21, four transverse holes 23 are spaced along its longitudinal axis 24 (FIG. 1). By way of example, the dimensions of the hammer 21 are $22\times6\times1.5$ mm for a weight of about 1 g.

The axis 24 of the hammer 21 lies substantially horizontally and the hammer has a slightly rounded rear head 25 shaped with a V-section notch 28 (FIG. 4) which can engage with a corresponding positioning wedge 29 of each blade 14 for striking the selected character 16 against the platen 13.

The hammer 21 is guided at the front by a rectangular hole 32 of a guide 33, and at the rear by a rectangular hole 34 of a guide 35. The two guides 33 and 35 are parallel to one another and are fixed by screws 38, 39 on to a support 40 which is in turn fixed to a carriage 41 (FIG. 1) of the printer, which carriage is slidable parallel to the platen 13 in any known way.

The support 40 has a lateral projection 45 on which there is mounted a shaft 47 about which is wound a helical spring 48. This spring 48 has a lower end 49 (FIG. 2) fixed to the shaft 47 and an elongate upper end 52 arranged within one of the holes 23 of the hammer 21. In the rest condition the spring 48 holds the hammer 21 spaced from the blades 14 of the character disc 12 with an applied force of about 100 g.

Figure 3:
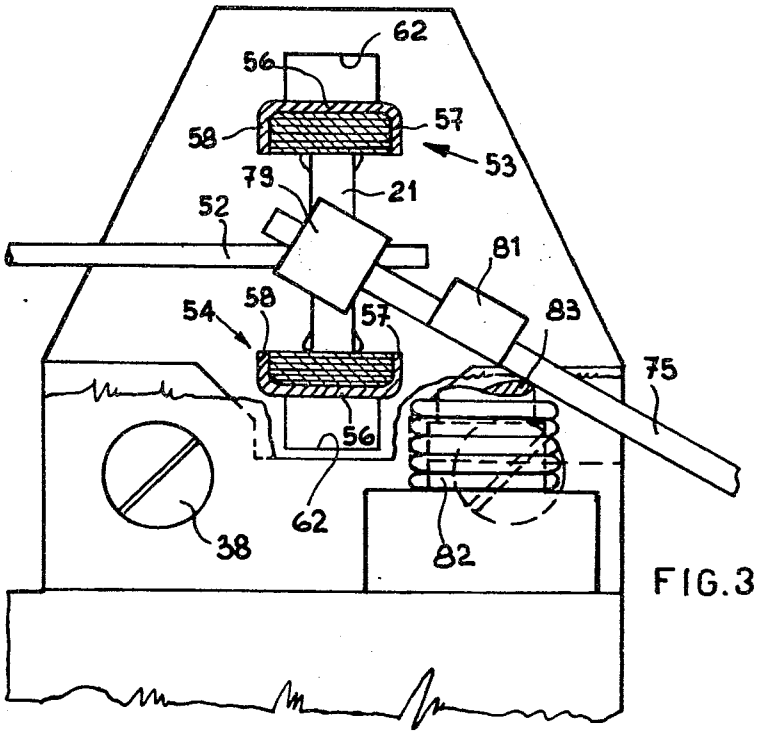
FIG. 3 is a partially sectioned rear view of the mechanism of FIG. 1.

Two elements 53 and 54 for damping the vibrations of the hammer 21 during its printing cycle are arranged on opposite sides with respect to the hammer 21. Each damper element 53 and 54 includes a felt pad 55 impregnated with lubricating oil, which is contained in a metal sheath 56 constituted by a thin plate bent in such a way as to have two side walls 57 and 58 (FIGS. 2 and 3) and two end tabs 59 and 60 (FIG. 1). These end tabs 59 and 60 are lodged in spaces 61 and 62 of the guides 33 and 35, disposed above and below the holes 32 and 34. The ends 65 and 66 of a C-shape spring 63 press the elements 53 and 54 against the hammer 21 with a predetermined force, for example 60 g which, for the coefficient of friction between the felt 55 and the hammer 21, corresponds to a resisting force of 20 g in the direction of the axis 24.

To one side with respect to the hammer 21 there is arranged a control electro-magnet 70 (FIG. 4), which includes a core 71 constituted by a plurality of laminations of ferro-magnetic material fixed to the carriage 41, an excitation winding 72 wound on the core 71, and an armature 73, also constituted by a plurality of laminations of ferro-magnetic material. The armature 73 is fixed to a lever 75 which is pivoted on a pivot pin 76 and which will be described in detail below. The lever 75 has an end 78 over which there is fitted a striker 79 which is normally in contact with the front part of the hammer 21. The electro-magnet 70 and the lever 75 lie in a plane inclined by about 30° with respect to the horizontal plane in order to permit a better view of the printed character.

Under the action of the spring 48 the lever 75 normally rests with a small pad 81 against a shock absorber spring 82 which is wound on a pin 83 (FIG. 1) held in vertical position by a support 84 fixed to the carriage 41. The pin 83 is cylindrical and the ends thereof have a diameter substantially equal to that of the internal diameter of the spring 82 with a central region of smáller diameter at the point where the small pad 81 of the lever 75 comes into contact with it, in such a way that the spring 82 can resiliently damp the return to rest of the hammer 21 and the lever 75 after each printing cycle.

Figure 5:
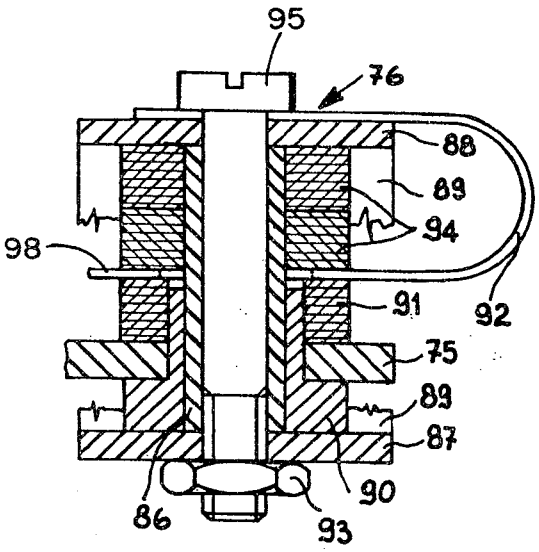
FIG. 5 is a detail, in section, of the mechanism of FIG. 1.
Figure 3:
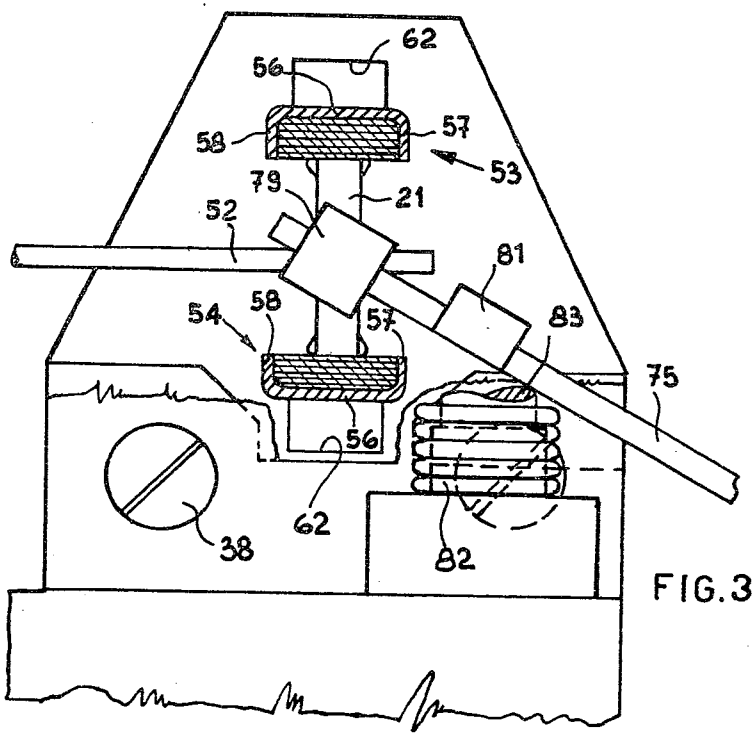
Figure 5:
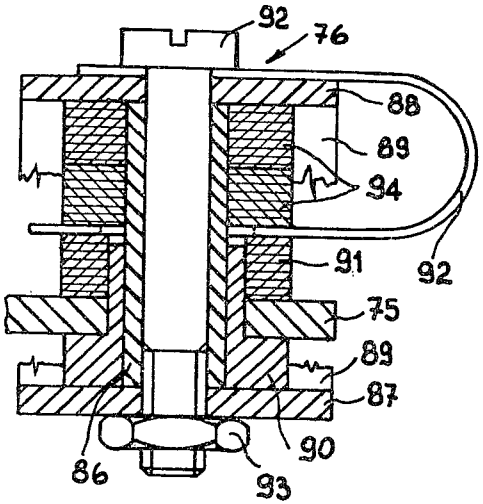

In accordance with one of the aspects of the invention the pivot pin 76 (FIG. 5) includes a metal cylinder 86 located between two tongues 87 and 88 of a fork 89 fixed to the carriage 41. A bush 90 on which the lever 75 is fixed is rotatably mounted on the cylinder 86. A felt washer 91 is disposed coaxially with respect to the bush 90 over the lever 75. A bow spring 92 is compressed between the felt washer 91 and the upper tongue 88 of the fork 89 by means of a screw 95 passing through the cylinder 86, and its nut 93. Finally, two felt washers 94 impregnated with lubricating oil are arranged coaxially with respect to the cylinder 86 between the upper tongue 88 of the fork 89 and the spring 92.

The spring 92 with its lower arm 98, constantly compresses the felt washer 91 against the lever 75, exercising a damping action on the lever 75 itself during its movements towards and away from the core 71 of the electro-magnet 70. The two washers 94 ensure a constant and long term lubrication of the pin 76.

For covering the striker mechanism 10 there is arranged a cover 96 (FIG. 1) of plastics material, provided with an aperture 97 through which the head 25 of the hammer 21 passes.

Figure 4:
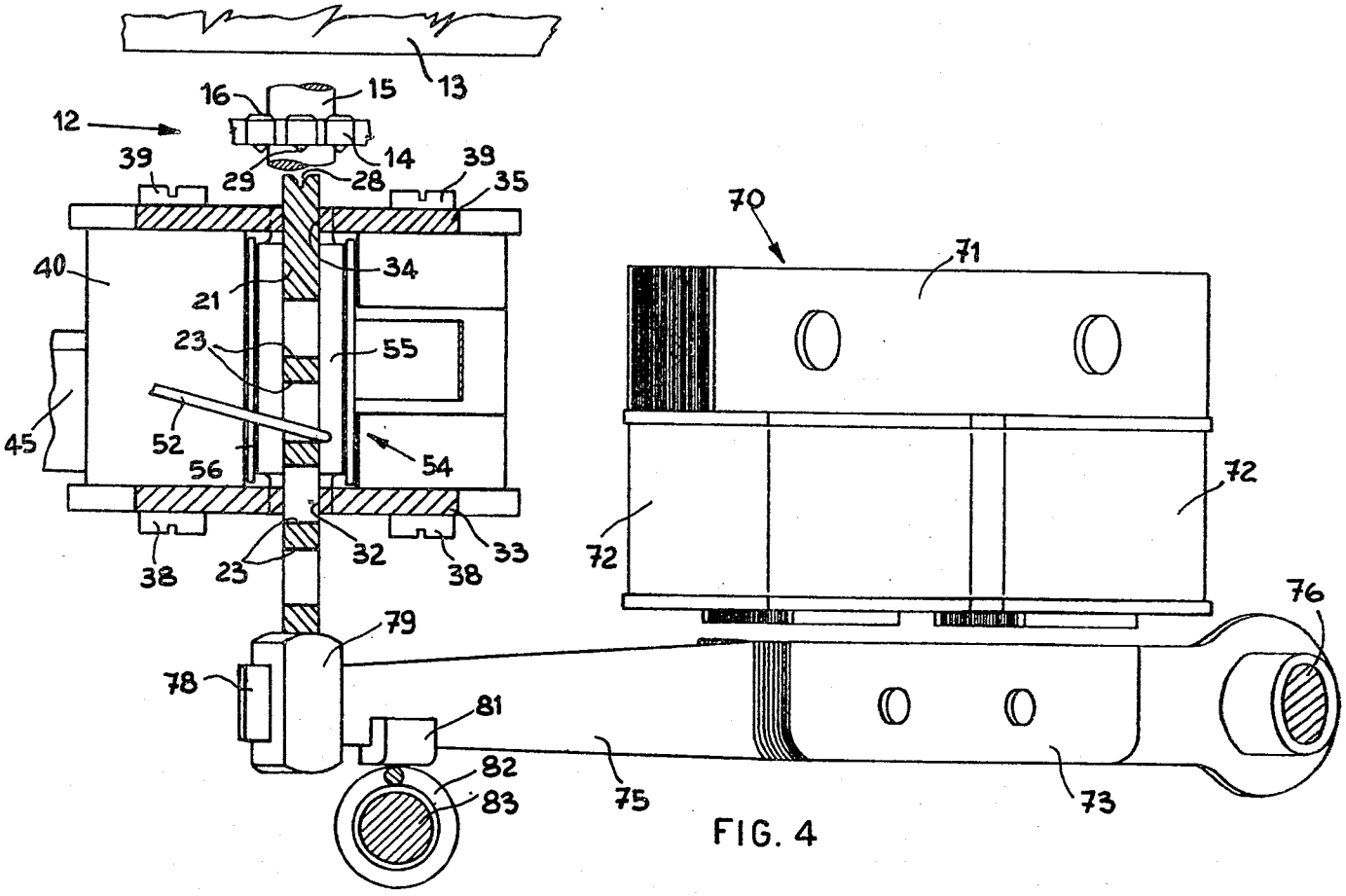
FIG. 4 is a partially sectioned plan view of the mechanism of FIG. 1.

The operation of the striker mechanism hereinabove described is as follows. In the rest condition, with the coil 72 not excited, the hammer 21 is spaced from the blades 14 of the discs 12 (FIG. 1) and the armature 73 is spaced from the core 71 of the electro-magnet 70 (FIG. 4).

To effect striking of a character of the disc 12 against the platen 13 for printing it, after having brought the selected character 16 in front of the hammer 21, the coil 72 is energised to attract the armature 73 towards the core 71 against the action of the spring 48.

In this way, after the hammer 21 is urged towards the platen 13 and after having engaged the wedge 29 of the selected strip 14 with its notch 28, printing of the corresponding character is effected. In particular, the striker head 79 of the lever 75 presses the hammer 21 positively until the armature 73 comes into contact with the core 71, thus making the hammer 21 perform a stroke of about 2 mm against the action of the spring 48 and the frictional resistance due to the presence of the felt pads 55. When the air gap between the armature 73 and the core 71 has closed, the hammer 21 continues its stroke by inertia until, after about a further 2.6 mm it carries the selected character against the platen 13. Thanks to the reduced mass of the hammer 21 the entire stroke is effected in a very short time, of the order of 2.3 ms. Moreover, the energy with which the hammer 21 carries the character 16 into contact with the platen 13 is sufficient to clearly imprint at least five copies.

The felt pads 55 and the springs 64, whilst only exercising a limited frictional resistance on the hammer 21 during its path towards the platen 13, completely absorb the transverse vibrations and thus contribute in a significant manner to maintaining the performance of the whole stroke to a short time.

Having effected the printing of a character, the spring 48 returns the hammer 21 and the lever 75 back to its rest position in a return time which is about 3 ms. The unit constituted by the hammer 21 and the lever 75 settles very rapidly, in about 1 ms, thanks to the presence of the damper elements 53 and 54, and to the spring 82 which absorb its vibrations. In this way after only 6.3 ms the electro-magnet 70 can be energised again for another printing cycle similar to that just above described, thus having a frequency of more than 150 strokes.

The data provided on the cycle times for printing and on the stroke of the hammer 21 are purely by way of example, and it is clear that it is possible to obtain a faster striker mechanism, for example by reducing the stroke of the hammer 21 and increasing the power of the electro-magnet 70.

What we claim is:

1. A striker mechanism for a high speed serial printer, including a characters bearing element and a platen, an elongated hammer having a longitudinal axis substantially perpendicular to said platen, a striking surface substantially perpendicular to said longitudinal axis for striking said characters bearing element toward said platen when the hammer is actuated, and one friction surface substantially parallel to said longitudinal axis; means for selectively actuating said hammer toward said platen in striking direction parallel to said longitudinal axis guide means for guiding said hammer during its actuation; and means for damping the vibrations of said hammer during its movements toward and away from said platen, said damping means comprising at least one damper element of soft material having a damping surface substantially parallel to the longitudinal axis of said hammer, means for maintaining said damper element substantially fixed with respect to said guide means, and means for urging said damper element toward said hammer for causing a predetermined pressure between said damping surface and said one friction surface, wherein said hammer comprises another friction surface opposite to said one friction surface, and wherein said damping means further comprises at least another damper element of soft material having a damping surface substantially parallel to the longitudinal axis of said hammer and constantly in contact with the other friction surface of said hammer.

2. A striker mechanism according to claim 1, wherein said urging means comprise a U-shaped spring having two arms which cooperate with at least two of said damper elements.

3. A striker mechanism according to claim 1, wherein each one of said damper elements comprises a felt pad contained in a corresponding support sheath.

4. A striker mechanism according to claim 3, wherein said guide means comprise two parallel plates substantially perpendicular to said longitudinal axis and provided with guide apertures wherein said hammer is slidable, wherein at least two of said damper elements are interposed between said two plates, and wherein one of said support sheaths is provided with support tabs housed in corresponding holes of said two plates.

5. A striker mechanism according to claim 4, wherein said hammer has a substantially parallelepipedal form having two larger sides and two shorter sides, wherein the one friction surface and the other friction surface are defined by said shorter sides, wherein said guide apertures include edges cooperative with both larger and shorter sides of said hammer, and wherein said urging means comprise a U-shaped spring having two arms engaging with said sheaths.

6. A striker mechanism according to claim 5, wherein said hammer comprises a series of lightening cavities on said larger sides.

7. A striker mechanism for a high speed serial printer, including a characters bearing element and a platen, an elongated hammer having a longitudinal axis substantially perpendicular to said platen, a striking surface substantially perpendicular to said longitudinal axis for striking said characters bearing element toward said platen when the hammer is actuated, and one friction surface substantially parallel to said longitudinal axis; means for selectively actuating said hammer toward said platen in striking direction parallel to said longitudinal axis; guide means for guiding said hammer during its actuation; and means for damping the vibrations of said hammer during its movements toward and away from said platen, said damping means comprising at least one damper element of soft material having a damping surface substantially parallel to the longitudinal axis of said hammer, and constantly in contact with said one friction surface of said hammer, means for maintaining said damper element substantially fixed with respect to said guide means, and means for urging said damper element toward said hammer for causing a predetermined pressure between said damping surface and said one friction surface, wherein said selectively actuating means comprise a control electromagnet having armature means pivoted on a pivot pin fixed with respect to said guide means and connected to said hammer and second damping means for damping the vibrations of said armature during its actuations, said second damping means comprising a cylindrical felt washer mounted coaxially with respect to said pivot pin, and a spring which constantly urges said cylindrical felt washer against said armature means.

8. A striker mechanism according to claim 7, wherein said second damping means further comprises at least another cylindrical felt washer, impregnated with lubricating oil, mounted coaxially with respect to said pivot pin.

9. A striker mechanism according to claim 7, further comprising third damping means for damping the return movement of said armature means after each actuation thereof, said third damping means comprising a first shaft fixed with respect to said guide means and having an axis substantially perpendicular to the longitudinal axis of said hammer and to said platen, a helical spring wound on said fixed shaft, said fixed shaft having a central part with a diameter smaller than the internal diameter of said helical spring, and a return spring for urging said armature means against said helical spring in correspondence with said central part of said fixed shaft.

10. A striker mechanism according to claim 9, wherein said hammer is provided with a plurality of lightening cavities, and wherein said return spring is helically wound about a second shaft fixed with respect to said guide means and substantially parallel to said first fixed shaft, said return spring having one end cooperating with one of said cavities for keeping said hammer spaced away from said characters bearing element when said control electromagnet is deenergized.

* * * * *